US011613849B2

(12) United States Patent
Froass

(10) Patent No.: US 11,613,849 B2
(45) **Date of Patent: *Mar. 28, 2023**

(54) ODOR CONTROL PULP COMPOSITION

(71) Applicant: INTERNATIONAL PAPER COMPANY, Memphis, TN (US)

(72) Inventor: Peter M. Froass, Cincinnati, OH (US)

(73) Assignee: International Paper Company, Memphis, TN (US)

( * ) Notice: Subject to any disclaimer, the term of this patent is extended or adjusted under 35 U.S.C. 154(b) by 16 days.

This patent is subject to a terminal disclaimer.

(21) Appl. No.: 17/001,449

(22) Filed: Aug. 24, 2020

(65) Prior Publication Data

US 2020/0385928 A1 Dec. 10, 2020

Related U.S. Application Data

(63) Continuation of application No. 15/918,725, filed on Mar. 12, 2018, now Pat. No. 11,332,886.

(60) Provisional application No. 62/474,515, filed on Mar. 21, 2017.

(51) Int. Cl.

| | |
|---|---|
| ***D21H 11/04*** | (2006.01) |
| ***D21H 17/66*** | (2006.01) |
| ***D21C 9/10*** | (2006.01) |
| ***D21C 9/16*** | (2006.01) |
| ***D21C 9/14*** | (2006.01) |
| ***D21H 11/20*** | (2006.01) |
| ***D21C 11/08*** | (2006.01) |
| ***D21H 21/32*** | (2006.01) |
| ***D21H 21/24*** | (2006.01) |
| ***D21C 9/00*** | (2006.01) |
| ***D21H 21/14*** | (2006.01) |
| ***D21H 17/00*** | (2006.01) |

(52) U.S. Cl.

CPC ..... *D21H 11/04* (2013.01); *D21C 9/00* (2013.01); *D21C 9/001* (2013.01); *D21C 9/004* (2013.01); *D21C 9/1036* (2013.01); *D21C 9/14* (2013.01); *D21C 9/16* (2013.01); *D21C 9/163* (2013.01); *D21C 11/08* (2013.01); *D21H 11/20* (2013.01); *D21H 17/66* (2013.01); *D21H 17/73* (2013.01); *D21H 21/14* (2013.01); *D21H 21/32* (2013.01)

(58) Field of Classification Search

CPC ..... D21H 11/20; D21H 17/63; D21H 17/66; D21H 17/73; D21H 21/36; D21H 11/04; D21C 9/00; D21C 9/001; D21C 9/002; D21C 9/004

See application file for complete search history.

(56) References Cited

U.S. PATENT DOCUMENTS

| | | | |
|---|---|---|---|
| 1,298,552 | A | 3/1919 | Ornstein |
| 1,298,553 | A | 3/1919 | Ornstein |
| 1,298,554 | A | 3/1919 | Ornstein |
| 1,657,140 | A | 1/1928 | Wenzl |
| 1,860,431 | A | 5/1932 | Richter |
| 1,890,179 | A | 12/1932 | Helder |
| 2,178,696 | A | 11/1939 | Muskat et al. |
| 2,212,338 | A | 8/1940 | Bown |
| 2,368,527 | A | 1/1945 | Edelstein et al. |
| 2,477,631 | A | 8/1949 | Levy et al. |
| 2,512,338 | A | 6/1950 | Klug et al. |
| 2,975,169 | A | 3/1961 | Cranford et al. |
| 3,308,012 | A | 3/1967 | Tobar |
| 3,617,432 | A | 11/1971 | Clayton et al. |
| 3,707,148 | A | 12/1972 | Bryce |
| 3,868,955 | A | 3/1975 | Steiger et al. |
| 4,022,965 | A | 5/1977 | Goheen et al. |
| 4,222,819 | A | 9/1980 | Fossum et al. |
| 4,270,976 | A | 6/1981 | Sandstrom et al. |
| 4,385,632 | A | 5/1983 | Odelhog |
| 4,410,397 | A | 10/1983 | Kempf |
| 4,427,490 | A | 1/1984 | Eckert |
| 4,444,621 | A | 4/1984 | Lindahl |
| 4,454,005 | A | 6/1984 | Stofko et al. |
| 4,458,042 | A | 7/1984 | Espy |
| 4,470,212 | A | 9/1984 | Stafford et al. |
| 4,562,969 | A | 1/1986 | Lindahl |
| 4,599,138 | A | 7/1986 | Lindahl |
| 4,614,646 | A | 9/1986 | Christiansen |
| 4,661,205 | A | 4/1987 | Ow et al. |

(Continued)

FOREIGN PATENT DOCUMENTS

| | | | |
|---|---|---|---|
| CA | 1129161 | A | 8/1982 |
| CA | 1190360 | A | 7/1985 |

(Continued)

OTHER PUBLICATIONS

Japan Notice of Rejection Office Action dated Nov. 22, 2018; JP Appn No. 2017252886.

Burgess, Relationship Between Colour Production in Cellulose and the Chemical Changes Brought about by Bleaching, 1982, The American Institute for Conservation, vol. 1, p. 4 figure 4.

Effect and Control of Transition Metal Ions During Paracid Bleaching, South China University of Technology, Guangzhou, 510640.

(Continued)

*Primary Examiner* — Eric Hug

(74) *Attorney, Agent, or Firm* — International Paper Company

(57) ABSTRACT

The present technology is directed to fluff pulps with improved odor control as well as methods of making such fluff pulps. A fluff pulp is provided that includes a bleached kraft fiber and a copper ion content from about 0.2 ppm to about 50 ppm by weight of the bleached kraft fiber. The bleached kraft fiber includes a length-weighted average fiber length of at least about 2 mm, a copper number of less than about 7, a carboxyl content of more than about 3.5 meq/100 grams; an ISO brightness of at least 80; and a viscosity from about 2 cps to about 9 cps.

44 Claims, No Drawings

(56) References Cited

U.S. PATENT DOCUMENTS

| | | | |
|---|---|---|---|
| 4,675,014 | A | 6/1987 | Sustmann |
| 4,756,799 | A | 7/1988 | Bengtsson et al. |
| 4,783,239 | A | 11/1988 | Rich |
| 4,869,783 | A | 9/1989 | Prusas et al. |
| 4,875,974 | A | 10/1989 | Rich |
| 4,889,595 | A | 12/1989 | Herron et al. |
| 5,002,635 | A | 3/1991 | Gentile, Jr. et al. |
| 5,080,754 | A | 1/1992 | Francis et al. |
| 5,296,099 | A | 3/1994 | Griggs et al. |
| 5,300,358 | A | 4/1994 | Evers |
| 5,383,864 | A | 1/1995 | van den Heuvel |
| 5,383,964 | A | 1/1995 | Sue et al. |
| 5,447,602 | A | 9/1995 | Sajbel et al. |
| 5,460,924 | A | 10/1995 | Buchanan et al. |
| 5,529,662 | A | 6/1996 | Tan et al. |
| 5,536,625 | A | 7/1996 | Buchanan et al. |
| 5,552,019 | A | 9/1996 | Weinstock et al. |
| 5,607,546 | A | 3/1997 | Hoglund et al. |
| 5,766,159 | A | 6/1998 | Martin et al. |
| 5,863,389 | A | 1/1999 | White et al. |
| 6,059,924 | A | 5/2000 | Hoskins |
| 6,063,982 | A | 5/2000 | Martin et al. |
| 6,126,838 | A | 10/2000 | Huang et al. |
| 6,214,164 | B1 | 4/2001 | Rantala |
| 6,258,207 | B1 | 7/2001 | Pan |
| 6,302,997 | B1 | 10/2001 | Hurter et al. |
| 6,306,253 | B2 | 10/2001 | Henricson |
| 6,368,456 | B1 | 4/2002 | Cimecioglu et al. |
| 6,379,494 | B1 | 4/2002 | Jewell et al. |
| 6,398,908 | B1 | 6/2002 | Hermansson et al. |
| 6,432,266 | B1 | 8/2002 | Fukushima et al. |
| 6,436,238 | B1 | 8/2002 | Pitkanen et al. |
| 6,458,245 | B1 | 10/2002 | Hoglund et al. |
| 6,514,380 | B1 | 2/2003 | Laine et al. |
| 6,562,195 | B2 | 5/2003 | Cimecioglu et al. |
| 6,605,350 | B1 | 8/2003 | Sealey, II et al. |
| 6,632,328 | B2 | 10/2003 | Wan et al. |
| 6,635,755 | B1 | 10/2003 | Jaschinski et al. |
| 6,695,950 | B1 | 2/2004 | Cimeciouglu et al. |
| 6,699,358 | B1 | 3/2004 | Evans et al. |
| 6,743,332 | B2 | 6/2004 | Haynes et al. |
| 6,765,042 | B1 | 7/2004 | Thornton et al. |
| 6,770,168 | B1 | 8/2004 | Stigsson |
| 6,773,552 | B1 | 8/2004 | Albert et al. |
| 6,824,645 | B2 | 11/2004 | Jaschinski et al. |
| 6,852,904 | B2 | 2/2005 | Sun et al. |
| 6,881,299 | B2 | 4/2005 | Parrish et al. |
| 6,923,889 | B2 | 8/2005 | Huuskonen et al. |
| 7,094,317 | B2 | 8/2006 | Lundberg et al. |
| 7,279,071 | B2 | 10/2007 | Williams et al. |
| 7,326,317 | B2 | 2/2008 | Westermark et al. |
| 7,520,958 | B2 | 4/2009 | Tan et al. |
| 7,582,308 | B2 | 9/2009 | Quincy, III |
| 8,007,635 | B2 | 8/2011 | Tan et al. |
| 8,262,850 | B2 | 9/2012 | Tan et al. |
| 10,174,455 | B2 | 1/2019 | Nonni |
| 2001/0028955 | A1 | 10/2001 | Luo et al. |
| 2001/0050153 | A1 | 12/2001 | Wajer et al. |
| 2002/0005262 | A1 | 1/2002 | Cimecioglu et al. |
| 2002/0144796 | A1 | 10/2002 | Wan et al. |
| 2002/0165110 | A1 | 11/2002 | Reinhardt et al. |
| 2003/0019596 | A1 | 1/2003 | Ragauskas et al. |
| 2003/0026828 | A1 | 2/2003 | Besemer et al. |
| 2003/0051834 | A1 | 3/2003 | Weerawarna |
| 2004/0154761 | A1 | 8/2004 | Duggirala et al. |
| 2004/0154765 | A1 | 8/2004 | Huuskonen et al. |
| 2005/0061455 | A1 | 3/2005 | Tan et al. |
| 2006/0144535 | A1 | 7/2006 | Nguyen et al. |
| 2006/0260773 | A1* | 11/2006 | Tan ..... D21H 11/04 162/182 |
| 2006/0289132 | A1 | 12/2006 | Heijnesson-Hulten |
| 2007/0000627 | A1 | 1/2007 | Tan et al. |
| 2007/0051481 | A1 | 3/2007 | Tan et al. |
| 2007/0100304 | A1 | 5/2007 | Fell |
| 2007/0119556 | A1 | 5/2007 | Tan et al. |
| 2007/0143932 | A1 | 6/2007 | Buchert et al. |
| 2007/0163735 | A1 | 7/2007 | Buchert et al. |
| 2008/0294132 | A1 | 11/2008 | Tan et al. |
| 2009/0054863 | A1 | 2/2009 | Tan et al. |
| 2009/0165968 | A1 | 7/2009 | Tan et al. |
| 2011/0287275 | A1 | 11/2011 | Tan et al. |
| 2012/0183772 | A1 | 7/2012 | Nonni |
| 2013/0066291 | A1 | 3/2013 | Tan et al. |
| 2013/0092336 | A1 | 4/2013 | Tan et al. |
| 2013/0098571 | A1 | 4/2013 | Tan et al. |
| 2013/0126109 | A1 | 5/2013 | Wang |
| 2013/0126111 | A1 | 5/2013 | Hage et al. |
| 2013/0197461 | A1 | 8/2013 | Nonni et al. |
| 2013/0248131 | A1 | 9/2013 | Nonni et al. |
| 2014/0000824 | A9 | 1/2014 | Hage et al. |
| 2014/0000825 | A1 | 1/2014 | Tan et al. |
| 2014/0274680 | A1* | 9/2014 | Nonni ..... D21C 9/004 428/401 |
| 2014/0318725 | A1 | 10/2014 | Nonni |
| 2015/0007953 | A1 | 1/2015 | Tan et al. |
| 2015/0080825 | A1 | 3/2015 | Tippey |
| 2016/0024713 | A1 | 1/2016 | Tan et al. |
| 2016/0040362 | A1 | 2/2016 | Nonni et al. |
| 2017/0172152 | A1 | 6/2017 | Tan et al. |
| 2017/0198436 | A1 | 7/2017 | Tan |
| 2018/0274172 | A1 | 9/2018 | Froass |
| 2019/0226153 | A1 | 7/2019 | Courchene |

FOREIGN PATENT DOCUMENTS

| | | | |
|---|---|---|---|
| EP | 1077285 | A1 | 2/2001 |
| EP | 1156065 | A1 | 11/2001 |
| EP | 1245722 | A2 | 10/2002 |
| EP | 1264846 | A1 | 12/2002 |
| EP | 1245722 | | 10/2003 |
| EP | 1862587 | A2 | 12/2007 |
| EP | 2527531 | | 11/2012 |
| EP | 2527531 | A1 | 11/2012 |
| FR | 2688787 | A1 | 9/1993 |
| GB | 555985 | A | 9/1943 |
| JP | S46-32442 | Y1 | 11/1971 |
| JP | 5181492 | A | 7/1976 |
| JP | S51-81492 | A | 7/1976 |
| JP | S58-054089 | A | 3/1983 |
| JP | H03-241079 | A | 10/1991 |
| JP | H08667 | A | 1/1996 |
| JP | H08-158284 | A | 6/1996 |
| JP | 2001-115389 | A | 4/2001 |
| JP | 2001-192991 | A | 7/2001 |
| JP | 2001-214399 | A | 8/2001 |
| JP | 2001-303473 | A | 10/2001 |
| JP | 2002-026701 | A | 1/2003 |
| JP | 2003-026701 | | 1/2003 |
| JP | 2003026701 | A | 1/2003 |
| JP | 2004-248859 | A | 9/2004 |
| JP | 2004-353118 | A | 12/2004 |
| JP | 2011-092991 | | 5/2011 |
| JP | 2012211411 | A | 11/2012 |
| JP | 2012528256 | A | 11/2012 |
| JP | 2015503686 | A | 2/2015 |
| JP | 2016513761 | A | 5/2016 |
| JP | 2017-014679 | | 1/2017 |
| JP | 6586155 | B2 | 10/2019 |
| RU | 2268327 | A | 5/2005 |
| RU | 2003131266 | A | 5/2005 |
| RU | 2608686 | | 6/2015 |
| WO | WO-95/35408 | | 12/1995 |
| WO | WO-1995/035408 | A1 | 12/1995 |
| WO | WO-1997/22749 | A1 | 6/1997 |
| WO | WO-9722749 | | 6/1997 |
| WO | WO-WO2001029309 | A1 | 4/2001 |
| WO | WO-2002/095129 | A1 | 11/2002 |
| WO | WO-2003/042451 | A2 | 5/2003 |
| WO | WO-2003/051410 | A1 | 6/2003 |
| WO | WO-2005/028744 | A1 | 3/2005 |
| WO | WO-2006/119392 | A1 | 11/2006 |
| WO | WO-2006/127880 | A2 | 11/2006 |

(56) References Cited

FOREIGN PATENT DOCUMENTS

WO WO-WO2010138941 A2 12/2010
WO WO-WO2014140940 A2 9/2014

OTHER PUBLICATIONS

Fibersource, Cellulose [downloaded online from http://www.fibersource.com/F-TUTOR/cellulose.htm], downloaded on Jan. 16, 2010, Fibersource, pp. 1-4.
G.A. Smook "Handbook, for Pulp Paper Technologist," 1992, Angus Wilde Publications, 2nd Edition, pp. 194-208.
Gullichsen et al., Chemical Pulping 6A, 1999, Fapet Oy, p. A207 and A653.
Kubelka et al. in "Delignification with Acidic Hydrogen Peroxide Activated by Molybdate", May 1992, Journal of Pulp and Paper Science, vol. 18, No. 3, pp. J108-J114.
Kubelka et al., Delignification with Acid Hydrogen Peroxide Activated by Molybdate, 1992, Journal of Pulp and Paper Science, whole document.
Lenntech, http://www.lentech.com/Fenton-reaction.htm [downloaded from www.archive.org], Jun. 28, 2003 [downloaded on Jun. 19, 2008], whole document.
Leporini et al. in "Hydrogen Peroxide in Chemical Pulp Bleaching—an overview-;" 2002; Congreso Iberoamericano de Invesigacion en cellulosa y Papel; CIADICYP; pp. 1-27.
Qian, Y; Goodell, B.; Genco, J.M., (2002); Journal of Wood Chemistry and Technology, vol. 22, No. 4, pp. 267-284, 2002.
Rahmawati et al. in "Pulp bleaching by hydrogen peroxide activated with copper 2,2_-dipyridylamine and 4-aminopyridine complexes;" 2005, Chemical Engineering Journal, vol. 112, pp. 167-171.
Rapson, editor, The Bleaching of Pulp, 1963, TAPPI Press, p. 106-111.
Ruuttunen et al. in "Concomitant Usage of Transition Metal Polyanioris as Catalysts in Oxygen Delignification: Laboratory Bleaching Trials;" 2006, Appita Journal, pp. 1-14.
Shenai, Studies in Chemically Modified Celluloses. IX. Oxidation of Cellulose in the Presence of Chelating Agents, 1976, Journal of Applied Polymer Science, vol. 20, pp. 385-391.
Shenai, V. A., and Date, A. G., "Studies in Chemically Modified Celluloses. IX. Oxidation of Cellulose in the Presence of Chelating Agents," 1976, Journal of Applied Polymer Science, vol. 20, whole document.
Sihtola et al., Comparison and Conversion of Viscosity and DP-Values Determined by Different Methods, 1963, Paperi ja Puu, p. 225-232.
Smith et al, The Effect of the Hypochlorite Bleaching Variables on Prehydroiysed Sulfate Hardwood Pulp Properties, 1960, TAPPI, vol. 43, No. 6, p. 596-599.
Smook, Handbook for Pulp and Paper Technologists, 1992, Angus Wilde Pubiications, 2nd edition, chapter 13.
Smook, Handbook for Pulp and Paper Technologists, 1992, Angus Wilde Publications, 2nd edition, chapter 9.
Smook, Handbook for ZPulp and Paper Technologists, 1992, Angus Wilde Publications, 2nd edition, Chapter 4.
Sun et al. Abstract of "The effect of rnetal ions on the reaction of hydrogen peroxide with Kraft lignin model compounds;" 1999, Can. J. Chem, vol. 77 (5-6, pp. 667-675).
Zeronian et al., Bleaching of cellulose by hydrogen peroxide, 1995, Cellulose, p. 265-272, whole document.
Zeronian et al., Bleaching of cellulose try hydrogen peroxide, 1995, Cellulose, whole document.
Standard Pulps 1-04, 5-96, E-16 meeting Standards, IGT Testing Systems K.K., Aug. 2, 2021, pp. 5-10, https://www.igt.jp/canadianpaper/fblnnobr2019.pdf.

* cited by examiner

ODOR CONTROL PULP COMPOSITION

FIELD

The present technology generally relates to fluff pulps with improved odor control as well as methods of making such fluff pulps.

SUMMARY

In one aspect, a fluff pulp is provided that includes a bleached kraft fiber and a copper ion content from about 0.2 ppm to about 50 ppm by weight of the bleached kraft fiber. The bleached kraft fiber includes a length-weighted average fiber length of at least about 2 mm, a copper number of less than about 7, a carboxyl content of more than about 3.5 meq/100 grams; an ISO brightness of at least 80; and a viscosity from about 2 cps to about 9 cps, and where the fluff pulp has a copper ion content from about 0.2 ppm to about 50 ppm by weight of the bleached kraft fiber.

In a related aspect, a process for preparing a fluff pulp is provided. The process includes treating a lignocellulosic material by adding from about 50 ppm to about 200 ppm by weight of the lignocellulosic material a catalyst consisting of a combination of copper and iron or salts thereof in the presence of from about 0.5% to about 5% oxidizing agent by weight of the lignocellulosic material to produce a treated lignocellulosic material. In the process, a weight ratio of iron and iron salts to copper and copper salts is at most about 10:1. The treated lignocellulosic material has a viscosity from about 2 cps to about 6 cps and has at least 50% greater inhibiting effect on ammonia formation than a second treated lignocellulosic material formed by the same process absent copper. The lignocellulosic material may be a lignocellulosic kraft pulp, such as a lignocellulosic kraft pulp that has been bleached with chlorine dioxide.

In any embodiment herein, it may be that the process includes treating lignocellulosic kraft pulp by adding from about 50 ppm to about 200 ppm by weight of the lignocellulosic kraft pulp the catalyst in the presence of from about 0.5% to about 5% oxidizing agent by weight of the lignocellulosic kraft pulp at an acidic pH to produce the treated lignocellulosic material.

In any embodiment herein, it may be that the process includes treating lignocellulosic kraft pulp by adding from about 50 ppm to about 150 (or about 200) ppm by weight of the lignocellulosic kraft pulp the catalyst in the presence of from about 0.5% to about 5% oxidizing agent by weight of the lignocellulosic kraft pulp at a pH from about 2.5 to about 5 to produce the treated lignocellulosic material; where the lignocellulosic kraft pulp is in an aqueous solution of about 8 wt % to about 12 wt % lignocellulosic kraft pulp based on water in the solution; a weight ratio of iron and iron salts to copper and copper salts is from about 8:1 to about 1:8; and the treated lignocellulosic material has a viscosity from about 3 cps to about 5 cps.

In a further related aspect, a process for improving odor control properties of a fluff pulp is provided. The process includes treating a first lignocellulosic material by adding from about 3.5 ppm to about 200 ppm of a copper salt and about 25 ppm to about 175 (or about 196.5) ppm of an iron salt at a pH of about 1 to about 9 to form a second lignocellulosic material, where a weight ratio of the iron salt to the copper salt is from about 8:1 to about 1:1; the dry second lignocellulosic material has at least 50% greater inhibiting effect on ammonia formation than dry first lignocellulosic material.

DETAILED DESCRIPTION

I. Definitions

The following terms are used throughout as defined below.

As used herein and in the appended claims, singular articles such as "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

As will be understood by one skilled in the art, for any and all purposes, particularly in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into sub-ranges as discussed above. Finally, as will be understood by one skilled in the art, a range includes each individual member. Thus, for example, a group having 1-3 atoms refers to groups having 1, 2, or 3 atoms. Similarly, a group having 1-5 atoms refers to groups having 1, 2, 3, 4, or 5 atoms, and so forth.

The term "halide" as used herein refers to bromide, chloride, fluoride, or iodide.

II. The Present Technology

Cellulose pulps have been used in a variety of personal care or medical care absorbent products, such as diaper fluff or incontinence articles. However, the odor caused by the body fluids is a major concern, such as the ammonia odor from urine in the case of diaper fluff. For other applications, malodorous issues may be caused by other nitrogen-containing or sulfur-containing substances.

The present technology is directed at fluff pulps that exhibit improved odor control as well as methods of generating such advantageous fluff pulps. The fluff pulps exhibit significantly improved odor control, at least in part, by employing surprisingly low amounts of copper. While especially suited to diaper fluff and incontinence articles, the present technology applies to any situation where odor control is beneficial and/or advantageous.

Thus, in an aspect, a fluff pulp is provided that includes a bleached kraft fiber and a copper ion content from about 0.2 ppm to about 50 ppm by weight of the bleached kraft fiber. The bleached kraft fiber includes a length-weighted average fiber length of at least about 2 mm, a copper number of less than about 7, a carboxyl content of more than about 3.5 meq/100 grams; an ISO brightness of at least 80; and a viscosity from about 2 cps to about 9 cps. The fluff pulp may or may not include a super-absorbent polymer (SAP), such as sodium polyacrylate polymers and co-polymers. The kraft fiber may be derived from softwood fiber, hardwood fiber, or a mixture thereof, where such fibers are described in more detail herein.

As described further herein and in addition to other features of the fluff pulp, it was surprisingly found including a copper ion content from about 0.2 ppm to about 50 ppm by weight of the bleached kraft fiber of copper significantly improved the odor control properties as compared to a fluff pulp that did not contain copper. Indeed, the significant odor control properties would not be expected by a person of ordinary skill in the art from the inclusion of such low copper ion content.

The fluff pulp may have at least 50% greater inhibiting effect on ammonia formation than a second fluff pulp with the same features but absent copper—that is, a fluff pulp of the same makeup except for the fact that no copper ion is included in the fluff pulp. An "inhibiting effect on ammonia formation" is where the fluff pulp exhibits less gaseous ammonia as determined by the tests of Example 1 (where no SAP is present) and/or Example 2 (where SAP is present) in comparison to a fluff pulp of the same makeup except for the fact that no copper ion is included in the fluff pulp. Without being bound by theory, this inhibiting effect may be from increased absorption of $NH_3$ in the fluff pulp, prevention of conversion of nitrogen-containing compounds to $NH_3$, or a combination of both. The inhibiting effect may be at least about 50% greater, at least about 55% greater, at least about 60% greater, at least about 65% greater, at least about 70% greater, at least about 75% greater, at least about 80% greater, at least about 85% greater, at least about 90% greater, at least about 92% greater, at least about 94% greater, at least about 96% greater, at least about 98% greater, at least about 99% greater, about 100% greater, or any range including and/or in-between any two of these values.

The copper ions of the copper ion content may be associated with the bleached kraft fiber, and/or may be in the form of a copper (I) salt, a copper (II) salt, hydrates thereof, or a combination of any two or more thereof. Copper (I) salts include, but are not limited to, copper (I) chloride, copper (I) oxide, copper (I) sulfate, or a combination of any two or more thereof. Copper (II) salts include, but are not limited to, copper (II) carbonate, copper (II) chloride, copper (II) phosphate, copper(II) nitrate, copper (II) perchlorate, copper (II) phosphate, copper (II) sulfate, copper (II) tetrafluoroborate, copper (II) triflate, or combinations of any two or more thereof. It may be a non-kraft fiber ligand of copper and/or salts thereof is included in the fluff pulp, where such ligands include but are not limited to ethylenediaminetetraacetic acid, (S,S')-ethylenediamine-N,N'-disuccinic acid, diethylenetriamine pentaacetic acid, ethyleneglycol-bis(2-aminoethyl)-N,N,N',N'-tetraacetic acid, trans-1,2-diaminocyclohexanetetraacetic acid, or a mixture of any two or more thereof. It may be a non-kraft fiber ligand is not included in the fluff pulp. In contrast to a non-kraft fiber ligand, a "kraft fiber ligand" is a moiety or portion of the kraft fiber.

The copper ion content of the fluff pulp as determined by weight of the bleached kraft fiber may be about 0.2 ppm, about 0.5 ppm, about 1 ppm, about 2 ppm, about 3 ppm, about 4 ppm, about 5 ppm, about 6 ppm, about 7 ppm, about 8 ppm, about 9 ppm, about 10 ppm, about 12 ppm, about 14 ppm, about 16 ppm, about 18 ppm, about 20 ppm, about 22 ppm, about 24 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, as well as any range including and/or in between any two of these values. The copper ion content may be determined by general analytical methods, such as ICP-Atomic Absorption. Thus, this value of the copper ion content refers to the mass amount $Cu^{+1}$ ions and/or $Cu^{+2}$ ions themselves as opposed to the total mass amount of the copper salts (e.g., the total mass amount of copper sulfate). As a further example, the mass amount of copper ions in copper sulfate is about 0.4 of the total mass amount of the copper sulfate.

The fluff pulp may or may not also include iron ions. Iron ions associated with the bleached kraft fiber may be in the form of ferrous ($Fe^{2+}$) salts, ferric ($Fe^{3+}$) salts, hydrates thereof, and combinations of any two or more thereof. Ferrous salts and/or ferric salts include halide, sulfate, nitrate, phosphate, carbonate, and combinations of any two or more thereof. Examples include, but are not limited to, ferrous sulfate (for example, ferrous sulfate heptahydrate), ferrous chloride, ferrous ammonium sulfate, ferric chloride, ferric ammonium sulfate, or ferric ammonium citrate. The amount of iron ions (the "iron ion content") in the fluff pulp may be from about 0.2 ppm to about 50 ppm by weight of the bleached kraft fiber; thus, the amount of iron ions by weight of the bleached kraft fiber may be about 0.2 ppm, about 0.5 ppm, about 1 ppm, about 2 ppm, about 3 ppm, about 4 ppm, about 5 ppm, about 6 ppm, about 7 ppm, about 8 ppm, about 9 ppm, about 10 ppm, about 12 ppm, about 14 ppm, about 16 ppm, about 18 ppm, about 20 ppm, about 22 ppm, about 24 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, or any range including and/or in-between any two of these values. The iron content may be determined by general analytical methods, such as ICP-Atomic Absorption.

As discussed previously, the bleached kraft fiber has a length-weighted average fiber length of at least about 2 mm. The bleached kraft fiber may have a length-weighted average fiber length of about 2 mm, about 2.1 mm, about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, about 3.7 mm, about 32.8 mm, about 3.9 mm, about 4.0 mm, or any range greater than any one of these values, or any range including and/or in-between any two of these values. Such length-weighted average fiber length may be determined via a Fiber Quality Analyzer™ from OPTEST, Hawkesbury, Ontario, according to the manufacturer's standard procedures.

The bleached kraft fiber has a copper number of less than about 7. Such copper number may be measured according to TAPPI T430-cm99. The bleached kraft fiber may have a copper number of about 1, about 2, about 3, about 4, about 5, about 6, about 7, or any range less than any one of these values, or any range including and/or in-between any two of these values. The bleached kraft fiber also has a carboxyl content of more than about 3.5 meq/100 grams, where carboxyl content may be measured according to TAPPI T237-cm98. Thus, the carboxyl content (in meq/100 grams) of the bleached kraft fiber may be about 3.6, about 3.8, about 4.0, about 4.5, about 5, about 5.5, about 6, about 6.5, about 7, about 7.5, about 8, or any range including and/or in-between any two of these values. Carboxyl content may be measured according to TAPPI T237-cm98.

The bleached kraft fiber of the fluff pulp has an ISO brightness of at least 80. The ISO brightness may be determined according to TAPPI T525-om02. The ISO brightness of the bleached kraft fiber may be 80, about 82, about 84, about 86, about 88, about 90, about 91, about 92, about 93, about 94, about 95, or any range including and/or in-between any two of these values. In any embodiment herein, it may be that the bleached kraft fiber does not include optical brighteners. In any embodiment herein, it may be that the fluff pulp does not include optical brighteners.

As previously noted herein, the bleached kraft fiber of the fluff pulp has a viscosity from about 2 cps to about 9 cps. The viscosity of the bleached kraft fiber may be determined according to the procedure of TAPPI T230-om99. Thus, the viscosity of the bleached kraft fiber may be about 2, about 2.5, about 3, about 3.5, about 4, about 4.5, about 5, about 5.5, about 6, about 6.5, about 7, about 7.5, about 8, about 8.5, about 9, or any range including and/or in-between any two of these values.

In a related aspect, a process for preparing a fluff pulp is provided. The process includes treating a lignocellulosic material by adding from about 50 ppm to about 200 ppm by weight of the lignocellulosic material of a catalyst consisting of a combination of copper and/or salts thereof and iron and/or salts thereof in the presence of from about 0.5% to about 5% oxidizing agent by weight of the lignocellulosic material to produce a treated lignocellulosic material. In the process, a weight ratio of iron and iron salts to copper and copper salts is at most about 10:1. The treated lignocellulosic material has a viscosity from about 2 cps to about 6 cps and has at least 50% greater inhibiting effect on ammonia formation than a second treated lignocellulosic material formed by the same process absent copper. The inhibiting effect may be at least about 50% greater, at least about 55% greater, at least about 60% greater, at least about 65% greater, at least about 70% greater, at least about 75% greater, at least about 80% greater, at least about 85% greater, at least about 90% greater, at least about 92% greater, at least about 94% greater, at least about 96% greater, at least about 98% greater, at least about 99% greater, about 100% greater, or any range including and/or in-between any two of these values.

The lignocellulosic material may preferably be a wood pulp. The lignocellulosic material may be in fibrous and/or particulate form, as for example pulp fibers, fines and/or other pulp fragments, hemicellulose, starch, and/or polysaccharide particles and powders. The lignocellulosic material may also include cellulose derivatives such as carboxymethyl cellulose, hydroxypropyl cellulose, and the like. Useful lignocellulosic materials include, but are not limited to, those derived from known sources of such materials as for example plants. Illustrative of useful lignocellulosic materials are polysaccharides such as starches as described in U.S. Pat. No. 8,007,635, incorporated herein by reference. Illustrative lignocellulosic materials for use in the processes described in any embodiment herein are pulp fibers used in the formation of tissues, towels, diapers, feminine hygiene and adult incontinence products and used to make other types of pulp products, paper, and/or paperboard. Such pulp fibers include those derived from hardwood trees, softwood trees, or a combination of hardwood and softwood trees prepared for use in a papermaking furnish by any known suitable digestion, refining, and/or bleaching operations—as, for example, known mechanical, thermo mechanical, chemical and semichemical, etc., pulping and other pulping processes known to a person of ordinary skill in the art. The term "hardwood pulps" as used herein refers to fibrous pulp derived from the woody substance of deciduous trees (angiosperms), whereas "softwood pulps"' are fibrous pulps derived from the woody substance of coniferous trees (gymnosperms). Useful pulp fibers may be provided from non-woody herbaceous plants including, but not limited to, kenaf, hemp, jute, flax, sisal, and/or abaca, although legal restrictions and other considerations may make the utilization of hemp and other fiber sources impractical or impossible. Either bleached or unbleached pulp fiber as for example unbleached kraft and bleached kraft pulp (collectively, "lignocellulosic kraft pulp"), and/or recycled pulp may be utilized in any embodiment of the processes described herein. A pulp may have been subjected to any treatment history that is normal in pulping and bleaching or may be intentionally modified, as for example by controlled pre-hydrolysis and/or caustic extraction of chips before kraft pulping, acid and/or enzyme (e.g., cellulases and/or hemicellulases) hydrolysis of kraft pulps, and/or "cold-soda" treatment of pulp (up to mercerizing strength).

"Copper and/or salts thereof" refers to elemental copper ($Cu^0$), a copper (I) salt, a copper (II) salt, hydrates thereof, or a combination of any two or more thereof. Copper (I) salts include, but are not limited to, copper (I) chloride, copper (I) oxide, copper (I) sulfate, or a combination of any two or more thereof. Copper (II) salts include, but are not limited to, copper (II) carbonate, copper (II) chloride, copper (II) phosphate, copper(II) nitrate, copper (II) perchlorate, copper (II) phosphate, copper (II) sulfate, copper (II) tetrafluoroborate, copper (II) triflate, or combinations of any two or more thereof. In any embodiment herein, the amount of copper and/or salts thereof added may be from about 3.5 ppm to about 199.8 ppm by weight of the lignocellulosic material; thus, the amount of copper or salts thereof added may be about 3.5 ppm, about 4 ppm, about 4.5 ppm, about 5 ppm, about 5.5 ppm, about 6 ppm, about 7 ppm, about 8 ppm, about 9 ppm, about 10 ppm, about 12 ppm, about 14 ppm, about 16 ppm, about 18 ppm, about 20 ppm, about 22 ppm, about 24 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, about 55 ppm, about 60 ppm, about 65 ppm, about 70 ppm, about 75 ppm, about 80 ppm, about 85 ppm, about 90 ppm, about 95 ppm, about 100 ppm, about 120 ppm, about 140 ppm, about 160 ppm, about 180 ppm, about 190 ppm, about 199.8 ppm, about 200 ppm, or any range including and/or in-between any two of these values.

"Iron and/or salts thereof" refers to elemental iron ($Fe^0$), ferrous ($Fe^{2+}$) salts, ferric ($Fe^{3+}$) salts, hydrates thereof, and combinations of any two or more thereof. Preferred salts of ferrous and/or ferric salts include halide, sulfate, nitrate, phosphate, carbonate, and combinations of any two or more thereof. Examples include, but are not limited to, ferrous sulfate (for example, ferrous sulfate heptahydrate), ferrous chloride, ferrous ammonium sulfate, ferric chloride, ferric ammonium sulfate, or ferric ammonium citrate. In any embodiment herein, the amount of iron or salts thereof added may be from about 0.2 ppm to about 180 ppm by weight of the lignocellulosic material; thus, the amount of iron or salts thereof added may be about 0.2 ppm, about 0.5 ppm, about 1 ppm, about 2 ppm, about 3 ppm, about 4 ppm, about 5 ppm, about 6 ppm, about 7 ppm, about 8 ppm, about 9 ppm, about 10 ppm, about 12 ppm, about 14 ppm, about 16 ppm, about 18 ppm, about 20 ppm, about 22 ppm, about 24 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, about 55 ppm, about 60 ppm, about 65 ppm, about 70 ppm, about 75 ppm, about 80 ppm, about 85 ppm, about 90 ppm, about 95 ppm, about 100 ppm, about 120 ppm, about 140 ppm, about 160 ppm, about 180 ppm, or any range including and/or in-between any two of these values.

In the process, the weight ratio of iron and iron salts to copper and copper salts is at most about 10:1. By "at most about 10:1," the phrase means no greater ratio of iron and iron salts to copper and copper salts is included, such as 11:1, but does not encompass a range where no iron is included as then there would be no ratio at all. The weight ratio of iron and iron salts to copper and copper salts may be about 10:1, about 9:1, about 8:1, about 7:1, about 6:1, about 5:1, about 4:1, about 3:1, about 2:1, about 1:1, about 1:2, about 1:3, about 1:4, about 1:5, about 1:6, about 1:7, about 1:8, about 1:9, about 1:10, or any range including and/or in-between any two of these values.

The oxidizing agent may include one or more of hydrogen peroxide, chlorine dioxide, hypochlorite, and hypochlorous acid. Preferred oxidizing agents include hydrogen peroxide. The amount of oxidizing agent is from about 0.5% to about 5% oxidizing agent by weight of the lignocellulosic material; thus, the amount of oxidizing agent may be about 0.5%, about 0.6%, about 0.7%, about 0.8%, about 0.9%, about 1%, about 1.2%, about 1.4%, about 1.6%, about 1.8%, about 2%, about 2.2%, about 2.4%, about 2.6%, about 2.8%, about 3%, about 3.2%, about 3.4%, about 3.6%, about 3.8%, about 4%, about 4.2%, about 4.4%, about 4.6%, about 4.8%, about 5%, or any range including and/or in-between any two of these values.

The catalyst may be added in the presence of the oxidizing agent by weight of the lignocellulosic material at a pH from about 1 to about 9. The treatment pH may vary widely and any temperature sufficient to form the desired treated lignocellulosic material can be used. The treatment pH may be about 1.0, about 1.5, about 2.0, about 2.5, about 3.0, about 3.5, about 4.0, about 4.5, about 5.0, about 5.5, about 6.0, about 6.5, about 7.0, about 7.5, about 8.0, about 8.5 about 9.0, or any range including and/or in-between any two of these values. For example, the pH may be an acidic pH (i.e., about 1 to less than about 7), and the pH may preferably be from about 2 to about 6, and more preferably from about 2.5 to about 5.

When the amount of another component is determined based on the weight of, e.g., lignocellulosic material, it is based on the dry weight of lignocellulosic material. The lignocellulosic material (for example, a lignocellulosic kraft pulp) may be in an aqueous solution of about 8 wt % to about 16 wt % lignocellulosic material based on water in the solution. Thus, the lignocellulosic material may be in an aqueous solution of about 8 wt %, about 9 wt %, about 10 wt %, about 11 wt %, about 12 wt %, about 13 wt %, about 14 wt %, about 15 wt %, about 16 wt %, or any range including and/or in-between these values.

Treatment temperatures may vary widely and any temperature sufficient to form the desired treated lignocellulosic product can be used. The treatment temperature is usually at least about 20° C., although lower temperatures may be used if effective to provide the desired lignocellulosic material. The treatment temperature may be about 20° C., about 40° C., about 50° C., about 60° C., about 65° C., about 70° C., about 75° C., about 80° C., about 85° C., about 90° C., about 95° C., about 100° C., about 110° C., about 120° C., or any range including and/or in-between any two of these values. The treatment temperature is preferably from about 40° C. to about 120° C., even more preferably from about 40° C. to about 90° C., and most preferably from about 65° C. to about 90° C.

Treatment times may vary widely and any time sufficient to form the desired treated lignocellulosic product can be used. The treatment time is usually at least about 5 minutes although longer treatment times may be used if effective to provide the desired lignocellulosic material. The treatment time is preferably from about 5 minutes to about 20 hours, more preferably about 15 minutes to about 10 hours and even more preferably from about 30 minutes to about 4 hours. Suitable treatment times include about 5 minutes, about 10 minutes, about 30 minutes, about 1 hour, about an hour and a half, about 2 hours, about 3 hours about 4 hours, about 6 hours, about 8 hours, about 10 hours, about 15 hours, about 20 hours, or any range including and/or in-between any two of these values.

Optionally, the process may or may not be carried out in the presence of UV radiation in addition to the catalyst and the oxidizing agent, and preferably when hydrogen peroxide is used as the oxidizing agent. Including UV radiation has the advantage of being more effective at lower temperatures such as room temperature (or ambient temperature) without need for heating equipment and may be used for widening the pH effective range. For example, the process may be effectively carried in the presence of UV radiation at ambient temperature (or without beating), at about neutral pH (i.e., about 6.8 to about 7.2,), and/or in a very short time of from a few seconds to about 1 hour, depending, e.g., on UV lamp power. The UV lamp used in the process preferably is a high intensity lamp, such a medium pressure mercury arc lamp or a variant thereof, a pulsed Xenon flash lamp, or an excimer lamp. It is most preferable to use a medium pressure mercury arc lamp which is low cost and readily available from commercial sources. One or more UV lamps, which are typically inserted in quartz sleeves, may be inserted (submerged) into the pulp for irradiation. Sometimes, it may be more advantageous to put UV lamps above the mixing suspension of the lignocellulosic material. For this type of UV irradiation, both mercury arc lamps and electrode-less powered lamps (such as from Fusion UV company) may be used. It is preferred that the pulp is fully mixed and well stirred during reaction as UV penetration in water is very low and most chemical action arises from UV decomposing the peroxide in aqueous solutions. In any embodiment herein, the UV treatment may or may not be performed with addition of a UV catalyst. Useful UV catalysts include, but are not limited to, micro- or nano-particulate titanium dioxide or zinc oxide photo-catalysts; an azo-based water-soluble organic catalyst, such as 4,4'-azobis(4-cyanovaleric acid), 2,2'-azobis(2 methylpropionamidine) dihydrochloride, 2,2'-azobis(2-methylpropionitrile) (AIBN), 1,1'-azobiscyclohexanecarbonitrile (e.g., DuPont VAZO® catalyst 88), and/or (2,2,6,6-tetramethyllpiperidinyl)oxyl (TEMPO).

The process may be conducted batch wise, continuously, or semi-continuously. The process may also be practiced as part of a pulping process as a process step at the end of a mechanical, semi-chemical or chemical pulping process or as a part of a multi-step bleaching process as a step at the end of the bleaching process (i.e., no further bleaching steps are performed after the treatment step of the process). The process may also be used to treat market paper making pulp and/or fluff pulp as for example by re-slushing market paper making pulp or fluff pulp in a hydro-pulper or like-device. The treatment in the hydro-pulper or like-device has the flexibility of adjusting conditions. For instance, the treatment may start at acidic pH and after some appropriate period of time the treatment includes adjusting to alkaline pH by the addition of caustic and continuing the reaction at higher pH. This combined acidic-alkaline treatment may be used to change the ratio of carboxyl vs. carbonyl groups in the treated lignocellulosic material.

The treated lignocellulosic material may possess any one or more features previously described for the fluff pulp (e.g., a length-weighted average fiber length of at least about 2 mm, a copper number of less than about 7, a carboxyl content of more than about 3.5 meq/100 grams; an ISO brightness of at least 80; and a viscosity from about 2 cps to about 9 cps, or combination of any two or more thereof) as well as any range described herein. In any embodiment herein, and as discussed previously for the fluff pulp, the treated lignocellulosic material may have a copper ion content from about 0.2 ppm to about 50 ppm by weight of the treated lignocellulosic material, or any range of copper ion content described herein. In any embodiment herein, and as discussed previously for the fluff pulp, the treated lignocellulosic material may have an iron ion content from about 0.2 ppm to about 50 ppm by weight of the treated lignocellulosic material.

In a further related aspect, a process for improving odor control properties of a fluff pulp is provided, where the process includes treating a first lignocellulosic material by adding from about 0.5 ppm to about 200 ppm of a copper salt at a pH of about 1 to about 9 to form a second lignocellulosic material, where the dry second lignocellulosic material has at least 50% greater inhibiting effect on ammonia formation than dry first lignocellulosic material. The inhibiting effect may be at least about 50% greater, at least about 55% greater, at least about 60% greater, at least about 65% greater, at least about 70% greater, at least about 75% greater, at least about 80% greater, at least about 85% greater, at least about 90% greater, at least about 92% greater, at least about 94% greater, at least about 96% greater, at least about 98% greater, at least about 99% greater, about 100% greater, or any range including and/or in-between any two of these values. The pH may be about 1.0, about 1.5, about 2.0, about 2.5, about 3.0, about 3.5, about 4.0, about 4.5, about 5.0, about 5.5, about 6.0, about 6.5, about 7.0, about 7.5, about 8.0, about 8.5 about 9.0, or any range including and/or in-between any two of these values.

In any embodiment of such a process herein, it may be the first lignocellulosic material does not contain more than about 0.2 ppm copper, and preferably no more than about 0.1 ppm copper, even more preferably no more than about 0.01 ppm copper. In any embodiment herein, it may be the first lignocellulosic material does not contain detectable copper as measured by ICP-Atomic Absorption.

Copper salts are described previously and the term "copper salt" is intended to mean either one copper salt, a mixture of any two or more copper salts, a hydrate of any one or more of the preceding, as well as a combination of any two or more thereof, where the amount of copper salt added may be about 0.5 ppm, about 0.6 pm, about 0.7 ppm, about 0.8 ppm, about 0.9 ppm, about 1.0 ppm, about 1.2 ppm, about 1.4 ppm, about 1.6 ppm, about 1.8 ppm, about 2.0 ppm, about 2.5 ppm, about 3.5 ppm, about 4 ppm, about 4.5 ppm, about 5 ppm, about 5.5 ppm, about 6 ppm, about 7 ppm, about 8 ppm, about 9 ppm, about 10 ppm, about 12 ppm, about 14 ppm, about 16 ppm, about 18 ppm, about 20 ppm, about 22 ppm, about 24 ppm, about 25 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, about 55 ppm, about 60 ppm, about 65 ppm, about 70 ppm, about 75 ppm, about 80 ppm, about 85 ppm, about 90 ppm, about 95 ppm, about 100 ppm, about 120 ppm, about 140 ppm, about 160 ppm, about 180 ppm, about 199.8 ppm, about 200 ppm, or any range including and/or in-between any two of these values.

Lignocellulosic materials have also been described previously. In the process, the lignocellulosic material is preferably a bleached kraft pulp, more preferably a fluff pulp that includes bleached kraft fiber. The bleached kraft fiber/pulp may possess any one or more features described for the bleached kraft fiber of the fluff pulp of the present technology (e.g., a length-weighted average fiber length of at least about 2 mm, a copper number of less than about 7, a carboxyl content of more than about 3.5 meq/100 grams; an ISO brightness of at least 80; and a viscosity from about 2 cps to about 9 cps, or combination of any two or more thereof) as well as any range described herein.

It may further be that an iron salt is added with the copper salt, such as about 25 ppm to about 175 ppm of an iron salt. Iron salts are described previously where and the term "iron salt" is intended to mean either one iron salt, a mixture of any two or more iron salts, a hydrate of any one or more of the preceding, as well as a combination of any two or more thereof. The amount of iron salt added may be about 25 ppm, about 26 ppm, about 28 ppm, about 30 ppm, about 32 ppm, about 34 ppm, about 36 ppm, about 38 ppm, about 40 ppm, about 42 ppm, about 44 ppm, about 46 ppm, about 48 ppm, about 50 ppm, about 55 ppm, about 60 ppm, about 65 ppm, about 70 ppm, about 75 ppm, about 80 ppm, about 85 ppm, about 90 ppm, about 95 ppm, about 100 ppm, about 120 ppm, about 140 ppm, about 160 ppm, about 165 ppm, about 170 ppm, about 175 ppm, or any range including and/or in-between any two of these values. In the process, the weight ratio of the iron salt to the copper salt is at most about 10:1. By "at most about 10:1," the phrase means no greater ratio of iron salts to copper salts is included, such as 11:1, but does not encompass a range where no iron is included as then there would be no ratio at all. The weight ratio of iron salts to copper salts may be about 10:1, about 9:1, about 8:1, about 7:1, about 6:1, about 5:1, about 4:1, about 3:1, about 2:1, about 1:1, about 1:2, about 1:3, about 1:4, about 1:5, about 1:6, about 1:7, about 1:8, about 1:9, about 1:10, or any range including and/or in-between any two of these values.

For example, the process may include treating the first lignocellulosic material by adding from about 3.5 ppm to about 200 ppm of a copper salt and about 25 ppm to about 175 ppm of an iron salt at a pH of about 1 to about 9 to form the second lignocellulosic material.

In any embodiment herein, the copper salt (and, when applicable, iron salt) may be added as an aqueous solution. In such embodiments, the process may include treating the first lignocellulosic material by adding an aqueous solution of the copper salt (and, where applicable, iron salt) at a pH of about 1 to about 9 to provide a wetted lignocellulosic material; and drying the wetted lignocellulosic material to form the second lignocellulosic material; where the second lignocellulosic material includes about 0.5 ppm to about 200 ppm of the copper salt (or any previously described range) and, when iron salt is included, about 25 ppm to about 175 ppm of the iron salt (or any previously described range). It may further be that the process includes drying the wetted lignocellulosic material followed by fiberizing to form the second lignocellulosic material.

In any embodiment herein, the second lignocellulosic material may possess any one or more features previously described for the fluff pulp (e.g., a length-weighted average fiber length of at least about 2 mm, a copper number of less than about 7, a carboxyl content of more than about 3.5 meq/100 grams; an ISO brightness of at least 80; and a viscosity from about 2 cps to about 9 cps, or combination of any two or more thereof) as well as any range described herein. In any embodiment herein, and as discussed previously for the fluff pulp, the treated lignocellulosic material may have a copper ion content from about 0.2 ppm to about 50 ppm by weight of the treated lignocellulosic material, or any range of copper ion content described herein. In any embodiment herein, and as discussed previously for the fluff pulp, the treated lignocellulosic material may have an iron ion content from about 0.2 ppm to about 50 ppm by weight of the treated lignocellulosic material.

The treated lignocellulosic material or second lignocellulosic material may be subjected to a number of subsequent treatments to further modify the properties of the material. For example, in any embodiment herein, the treated lignocellulosic material or second lignocellulosic material may be treated with a cationic agent which (without being bound by theory) is believed to bind the reducing functional groups of the treated materials. Useful cationic material can vary widely and includes, but is not limited to, cationic nitrogen containing polymers such as polyamines, 1-ethyl-3-(3-dimethylaminopropyl)-carbodiimide hydrochloride (EDC), hexadimethrine bromide, polyethyleneimines (linear and/or branched), copolymers of diallyldimethylammonium chloride (DADMAC). copolymers of vinyl pyrrolidone (VP) with quaternized diethylaminoethylmethacrylate (DEAMEMA), polyamides, cationic polyurethane latex, cationic polyvinyl alcohol, polyalkylamines, dicyandiamide copolymers, amine glycidyl addition polymers, poly [oxyethylene (dimethyliminio) ethylene (dimethyliminio)ethylene] dichlorides, high charge-density polyvinylamine, polyallylamine (PAH), poly (hexamethylene biguanide hydrochloride) (PHMB), polyamidoamine (or polyethyleneimine); cationic metal ions, such as water-soluble aluminum salts, calcium salts, and/or zirconium salts; and cationic dendrimen, such as (polyamidoamine) dendrimers (PAMAM dendrimers) with amino surface groups, and polypropylenimine dendrimers with amino surface groups. Without being bound by theory, it is believed that treatment with such cationic materials may modify properties such as increase paper bulk, which is desirable for fine paper, paperboard, tissue, towel, and absorbent products, while maintaining good strength and having decreased water retention value (WRV) and increased freeness.

The treated lignocellulosic material or second lignocellulosic material may be treated with micro- or nano-particulate metal oxides such as aluminum oxide, titanium oxide, zinc oxide, and/or silica, where such materials are retained by the treated lignocellulosic material to modify properties such as colorant fixation, dye fixation, optical brightener fixation, printability, and/or odor control characteristics. The treated lignocellulosic material or second lignocellulosic material may be treated with a cross linking material during papermaking or fibrous network forming. Exemplary cross linking materials include a water-dispersible or water-soluble bi- or multi-functional carbodiimide and/or polycarbodiimide, such as 1,6-hexamethylene bis(ethylcarbodiimide); 1,8-octamethylene bis(ethylcarbodiimide); 1,10-decamethylene bis(ethylcarbodiimide); 1,12-dodecamethylene bis(ethylcarbodiimide); PEG-bis(propyl(ethylcarbodiimide)); 2,2'-dithioethyl bis(ethylcarbodiimde); 1,1'-dithio-p-phenylene bis (ethylcarbodiimide); and 1,1'-dithio-m-phenylene bis (ethylcarbodiimide). The bi- or multi-functional carbodiimide groups react with the reducing functional groups of the treated lignocellulosic material (or second lignocellulosic material) and cross-link fibers of the material inside the paper or fiber network structure.

The treated lignocellulosic material or second lignocellulosic material may be used for conventional purposes in situ or after isolation using conventional product isolation techniques. For example, the treated lignocellulosic material or second lignocellulosic material may be used to make paper or paperboard substrates or webs. Methods and apparatuses for preparing a substrate formed of lignocellulosic fibers are well-known in the paper and paperboard art. See, for example, "Handbook For Pulp & Paper Technologies," $2^{nd}$ Edition, G. A. Smook, Angus Wilde Publications (1992) and references cited therein. Any conventional method and apparatus may be used. Preferably, such a process for using the treated lignocellulosic material (or second lignocellulosic material) includes: a) depositing an aqueous suspension of lignocellulosic fibers from the treated lignocellulosic material on a forming wire of a paper making machine to form a wet paper or paperboard web; b) drying the wet paper or paperboard web to obtain dried paper or paperboard web and c) calendering the dried paper or paperboard web. In addition to these, additional steps known to those of ordinary skill in the art may be employed; for example, a coating step to coat one or more surfaces of the dried paper or paperboard web with a coating that includes a binder containing dispersant pigment, and/or treating the dried paper or paperboard at a size press with a sizing agent such as starch.

The treated lignocelluosic material or second lignocellulosic material may be used to prepare absorbent articles, for example, diapers, tissues, towels, and/or personal hygiene products, using conventional processes. Such products and their methods of manufacture are known to those of ordinary skill in the art. See, for example, U.S. Pat. Nos. 6,063,982 and 5,766,159 (both of which are incorporated herein by reference, except any portion(s) thereof that may be contradictory to the present teachings), and references described therein. The treated lignocellulosic kraft pulp (which necessarily includes treated kraft pulp fibers) may be used to make saturating kraft paper. Saturating kraft paper is a paper sheet made from unbleached kraft pulp (typically a mixture of mostly hardwood and some softwood such as southern pine) that is used as substrate for impregnation and curing with resin polymers. Saturating kraft paper is used as home and office building materials, such as kitchen counter tops. A useful property of saturating kraft paper is control the liquid (typically a polymer resin solution) penetration rate into the sheet, while maintaining paper porosity and density. All of the hardwood kraft fiber in the saturating sheet may be replaced by softwood as for example southern pine kraft (linerboard grade pine kraft) treated by the processes of any embodiment herein to provide saturating kraft paper having with good liquid transport properties.

EXAMPLES

The examples herein are provided to illustrate advantages of the present technology and to further assist a person of ordinary skill in the art with preparing or using the processes of the present technology. The examples herein are also presented in order to more fully illustrate the preferred aspects of the present technology. The examples should in no way be construed as limiting the scope of the present technology. The examples can include or incorporate any of the variations, embodiments, or aspects of the present technology described above. The variations, embodiments, or aspects described above may also further each include or incorporate the variations of any or all other variations, embodiments, or aspects of the present technology.

Example 1. Technique to Measure the Ammonia Inhibiting Properties of Fluff Pulp without SAP A sheet of fluff pulp is cut into 2 inch strips and fiberized using a Kamas H01 laboratory Hammermill. The fiberized pulp is made into an airlaid 50 mm diameter pad using an airlaid pad former. Each pad is made with 4 grams of fiberized pulp unless otherwise noted. The pad is compressed in a carver press to approximately 0.15 g/cc density. Two compressed pads are placed in an airtight 1 liter bottle. 40 mL of a freshly prepared 1.0% solution of urease (Urease from *Canavalia ensiformis* (Jack Bean), purchased from Sigma) in synthetic urine (RICCA Chemical Company) is added to each 4 gram pad and the bottle is sealed. After 8 hours, a Draeger Tube is used to detect the ammonia concentration in the headspace of the bottle. As provided by this procedure, the lower the concentration of ammonia, the better the ammonia inhibition effect of the fiberized fluff pulp.

Example 2. Technique to Measure the Ammonia Inhibiting Properties of Fluff Pulp with SAP A sheet of fluff pulp is cut into 2 inch strips and fiberized using a Kamas H01 laboratory Hammermill. The fiberized pulp is mixed with SAP for a total weight of 10 grams. For example, if a 10% SAP pad is required, then 9 grams of fiberized pulp are mixed with 1 gram of SAP. The SAP used is HySorb® 9400 (BASF) unless otherwise noted. The mixture of fiberized pulp and SAP is then fed into an airlaid pad former to form a 100 $cm^2$ round pad. The pad is compressed to approximately 0.15 g/cc using a carver press. The pad is placed into a 7 liter airtight container. 100 ml of 1.0% urease solution (described in Example 1) is added to the pad and the container is sealed. After 8 hours, a Draeger Tube is used to detect the ammonia concentration in the headspace of the container.

Example 3

A pulp was collected after the first chlorine dioxide brightening ($D_1$) stage in a commercial scale $D_0E_{op}D_1D_2$ bleaching sequence and had a 16.5 cps viscosity. This pulp was treated in an acidic bleaching stage containing different types and amounts of metal salts, as noted in Table 1. Each treatment utilized 100 grams of dry pulp at 10% consistency (i.e., 10 wt % pulp in solution) and 3% hydrogen peroxide (i.e., 3 wt % based on pulp) at a temperature of 85° C. for a period of 130 minutes.

After the treatment, the pulps were washed with 4 L of deionized water and thickened to approximately 20% solids. The thickened pulp was then diluted to approximately 1% consistency with DI water and formed into a 750 gsm handsheet on an 8 inch by 8 inch handsheet mold. The wet pulp sheet was pressed between blotter paper to remove excess liquid and subsequently dried on a rotary drum dryer at 250° F. The ammonia inhibiting properties of the dried sheet were then explored with and without SAP as described in Examples 1 and 2. As shown in Table 1, using as little as 25 ppm $CuSO_4$ in combination with the $FeSO_4$ had a pronounced inhibiting effect on ammonia formation: the ammonia inhibition when no SAP was included as about 50% (100%−(3 ppm $NH_3$/6 ppm $NH_3$×100%)=50%) when 25 ppm $CuSO_4$ was used in the acidic peroxide bleaching versus Entry 1. Moreover, when 50 ppm $CuSO_4$ was used in combination with 55 ppm $FeSO_4$, there was 100% ammonia inhibition when no SAP was included and about 82% ammonia inhibition when 10% SAP was included.

TABLE 1

| Entry | $FeSO_4$ (ppm) | $CuSO_4$ (ppm) | Final pH | Viscosity (cps) | Ammonia formation with no SAP (ppm $NH_3$) | Ammonia formation with 10% SAP (ppm $NH_3$) |
|---|---|---|---|---|---|---|
| 1 | 200 | 0 | 3.1 | 6.2 | 6 | 65 |
| 2 | 64 | 25 | 3 | 6.2 | 3 | 60 |
| 3 | 55 | 50 | 3 | 5.8 | 0 | 12 |
| 4 | 36 | 100 | 2.9 | 5.3 | 0 | 5 |
| 5 | 175 | 25 | 2.8 | 4.8 | 2 | 25 |
| 6 | 150 | 50 | 2.8 | 4.3 | 1 | 10 |
| 7 | 100 | 100 | 2.8 | 4.3 | 0 | 9 |

Example 4

Commercial production conditions were conducted at International Paper's Riegelwood, N.C. mill. This mill bleaches kraft softwood pulp with a $D_0E_{op}D_1D_2$ bleaching sequence. The $D_2$ stage was altered to produce a low viscosity pulp using 3% hydrogen peroxide and metal salt, where the metal salt composition and content were varied. The first pulp (entry 1, Table 2) was produced using 150 ppm $FeSO_4$ as the only metal salt. The second pulp (entry 2, Table 2) was produced using 125 ppm $FeSO_4$ and 25 ppm $CuSO_4$. Both of these reaction conditions resulted in pulps with low viscosity.

Each pulp was then made into a fluff pulp sheet on a Fourdrinier-type papermachine with cylindrical steam-heated can dryers. Samples of the each dried sheet were then collected and tested for ammonia inhibition as described in Examples 1 and 2. As illustrated in Table 2, as little as 25 ppm $CuSO_4$ used in the acidic hydrogen peroxide bleaching stage had a pronounced inhibiting effect on ammonia formation. This result was found for pads made with and without SAP.

TABLE 2

| Entry | $FeSO_4$ (ppm) | $CuSO_4$ (ppm) | Final pH | Viscosity (cps) | Ammonia formation with no SAP (ppm $NH_3$) | Ammonia formation with 10% SAP (ppm $NH_3$) |
|---|---|---|---|---|---|---|
| 1 | 150 | 0 | 3.4 | 3.1 | 23 | 99 |
| 2 | 125 | 25 | 2.8 | 3.7 | 1 | 2 |

Example 5

A fluff pulp sheet (RW SuperSoft® Plus; commercially produced by International Paper) was soaked in a deionized water bath at room temperature (72° F.) for one minute with increasing concentrations of copper (II) sulfate pentahydrate ($CuSO_4 \cdot 5H_2O$). After the soaking procedure, the pulp sheet was pressed between blotter paper to remove excess liquid and the sheet was dried on a rotary drum dryer at 250° F. The dried sheet was then tested for ammonia inhibition as described in Examples 1 and 2, where Table 3 shows the results from these tests. As little as 1.0 ppm $Cu^{2+}$ had a pronounced inhibiting effect on ammonia formation.

TABLE 3

| Entry | Fluff Sheet Wt. (grams) | Wet Wt. after soaking and Pressing (grams) | Wet Pickup (grams) | Conc. of $Cu^{2+}$ in solution (wt. %) | Pickup $Cu^{2+}$ (ppm) | No SAP $NH_3$ formation (ppm; Test 1/ Test 2) | 10% SAP $NH_3$ formation (ppm; Test 1) |
|---|---|---|---|---|---|---|---|
| 1 (Control) | 54.4 | 96.8 | 42.4 | 0 | 0 | 70/65 | 300 |
| 2 | 54.4 | 98.2 | 43.8 | 0.00013 | 1.0 | 2/5 | 85 |
| 3 | 53.5 | 69.6 | 43.1 | 0.00065 | 5.2 | 4/2 | 32 |
| 4 | 54.6 | 102.4 | 47.8 | 0.00130 | 44.4 | 3/1 | 23 |

Example 6

A fluff pulp sheet (RW SuperSoft® Plus; commercially produced by International Paper) was sprayed with different aqueous solutions containing deionized water and varying concentrations of copper (II) sulfate pentahydrate ($CuSO_4 \cdot 5H_2O$). The fluff pulp sheet was sprayed until it became visibly wet. After the spraying procedure, each pulp sheet was pressed between blotter paper to remove excess liquid and the sheet was dried on a rotary drum dryer at 250° F. Each dried sheet was then tested for ammonia inhibition as described in Example 1, where Table 4 shows the results from these tests. As little as 0.7 ppm $Cu^{2+}$ had a pronounced inhibiting effect on ammonia formation.

TABLE 4

| Entry | Fluff Sheet Wt. (grams) | Wet Wt. after soaking and Pressing (grams) | Wet Pickup (grams) | Conc of $Cu^{2+}$ in solution (wt. %) | Pickup $Cu^{2+}$ (ppm) | No SAP $NH_3$ formation, (ppm; Test 1) |
|---|---|---|---|---|---|---|
| 1 (Control) | 59.9 | 104.4 | 44.5 | 0 | 0 | 65 |
| 2 | 60.0 | 91.3 | 31.3 | 0.00013 | 0.7 | 22 |
| 3 | 59.9 | 92.9 | 34.1 | 0.00065 | 3.7 | 2 |

The present technology is not to be limited in terms of the particular figures and examples described herein, which are intended as single illustrations of individual aspects of the present technology. Many modifications and variations of this present technology can be made without departing from its spirit and scope, as will be apparent to those skilled in the art. Functionally equivalent methods within the scope of the present technology, in addition to those enumerated herein, will be apparent to those skilled in the art from the foregoing descriptions. Such modifications and variations are intended to fall within the scope of the appended claims. It is to be understood that this present technology is not limited to particular methods, reagents, compounds, compositions, or labeled compounds, which can, of course, vary. It is also to be understood that the terminology used herein is for the purpose of describing particular aspects only, and is not intended to be limiting.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

In addition, where features or aspects of the disclosure are described in terms of Markush groups, those skilled in the art will recognize that the disclosure is also thereby described in terms of any individual member or subgroup of members of the Markush group. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

All publications, patent applications, issued patents, and other documents (for example, journals, articles and/or textbooks) referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims, along with the full scope of equivalents to which such claims are entitled.

The invention claimed is:

1. A fluff pulp comprising:

bleached kraft fiber comprising a length-weighted average fiber length of at least about 2 mm;

a copper number of less than about 7; and a ISO brightness of at least 80, and a copper ion content from about 0.7 ppm to about 3.7 ppm by weight of the bleached kraft fiber.

2. The fluff pulp of claim 1, wherein copper ions of the copper ion content comprise a copper (I) salt, a copper (II) salt, hydrates thereof, or a combination of any two or more thereof.

3. The fluff pulp of claim 1, wherein copper ions of the copper ion content comprise one or more of elemental copper, copper (I) chloride, copper (I) oxide, copper (I) sulfate, copper (II) carbonate, copper (II) chloride, copper (II) phosphate, copper(II) nitrate, copper (II) perchlorate, copper (II) phosphate, copper (II) sulfate, copper (II) tetrafluoroborate, and copper (II) triflate.

4. The fluff pulp of claim 1, wherein the fluff pulp further comprises iron ions.

5. The fluff pulp of claim 4, wherein the fluff pulp comprises an iron ion content from about 0.2 ppm to about 50 ppm by weight of the bleached kraft fiber.

6. The fluff pulp of claim 1, wherein the fluff pulp does not comprise a super-absorbent polymer (SAP).

7. The fluff pulp of claim 1, wherein the fluff pulp has a carboxyl content of more than about 3.5 meq/100 grams.

8. A process for preparing the fluff pulp of claim 1 comprising:

treating the bleached kraft fiber by adding from about 0.2 ppm to about 50 by weight of the bleached kraft fiber of copper or salts thereof to produce the fluff pulp;

wherein the fluff pulp has at least 50% greater inhibiting effect on ammonia formation than a second bleached kraft fiber formed by the same process absent copper.

9. The process of claim 8, wherein the copper or salts thereof consist of one or more of elemental copper ($Cu^0$), a copper (I) salt, and a copper (II) salt.

10. The process of claim 8, wherein the copper or salts thereof consist of elemental copper, copper (I) chloride, copper (I) oxide, copper (I) sulfate, copper (II) carbonate, copper (II) chloride, copper (II) phosphate, copper(II) nitrate, copper (II) perchlorate, copper (II) phosphate, copper (II) sulfate, copper (II) tetrafluoroborate, copper (II) triflate, hydrates thereof, or combinations of any two or more thereof.

11. The process of claim 8, further comprising bleaching a kraft fiber with a multi-step bleaching process to produce a bleached kraft fiber, wherein the treating occurs after the bleaching.

12. The process of claim 8, further comprising bleaching a kraft fiber with a multi-step bleaching process to produce a bleached kraft fiber, wherein no further bleaching is performed after the treating.

13. The process of claim 8, wherein the fluff pulp does not comprise a super-absorbent polymer (SAP).

14. The process of claim 8, wherein the fluff pulp has a carboxyl content of more than about 3.5 meq/100 grams.

15. The process of claim 8, wherein the fluff pulp further comprises iron ions.

16. The process of claim 15, wherein the fluff pulp comprises an iron ion content from about 0.2 ppm to about 50 ppm by weight of the bleached kraft fiber.

17. The process of claim 8, comprising treating the bleached kraft fiber by adding from about 0.7 ppm to about 3.7 ppm by weight of the bleached kraft fiber of copper or salts thereof to produce the fluff pulp.

18. A fluff pulp, comprising:

bleached kraft fiber comprising a length-weighted average fiber length of at least about 2 mm;

a copper number of less than about 7; and a ISO brightness of at least 80, and a copper ion content from about 0.2 ppm to about 50 ppm by weight of the bleached kraft fiber, wherein the fluff pulp inhibits the effect on ammonia formation to 22 ppm or less of ammonia eight (8) hours after the fluff pulp is subjected to an ammonia generation test in the absence of super-absorbent polymer (SAP), the ammonia generation test consisting of steps of:

i) the fluff pulp is cut into 2 inch strips and fiberized using a Kamas H01 laboratory Hammermill creating a fiberized fluff pulp;

ii) the fiberized fluff pulp is made into an airlaid 50 mm diameter pad using an airlaid pad former;

iii) each pad is made with 4 grams of fiberized fluff pulp and compressed in a carver press to approximately 0.15 g/cc density;

iv) two compressed pads are placed in an airtight 1 liter bottle;

v) 40 mL of a freshly prepared 1.0% solution of urease (Urease from Canavalia ensiformis (Jack Bean), purchased from Sigma) in synthetic urine (RICCA Chemical Company) is added to each 4 gram pad and the bottle is sealed; and vi) a Draeger Tube is used to detect the ammonia concentration in the headspace of the bottle.

19. The fluff pulp of claim 18, wherein copper ions of the copper ion content comprise a copper (I) salt, a copper (II) salt, hydrates thereof, or a combination of any two or more thereof.

20. The fluff pulp of claim 18, wherein copper ions of the copper ion content comprise one or more of elemental copper, copper (I) chloride, copper (I) oxide, copper (I) sulfate, copper (II) carbonate, copper (II) chloride, copper (II) phosphate, copper(II) nitrate, copper (II) perchlorate, copper (II) phosphate, copper (II) sulfate, copper (II) tetrafluoroborate, and copper (II) triflate.

21. The fluff pulp of claim 18, wherein the fluff pulp further comprises iron ions.

22. The fluff pulp of claim 21, wherein the fluff pulp comprises an iron ion content from about 0.2 ppm to about 50 ppm by weight of the bleached kraft fiber.

23. The fluff pulp of claim 18, wherein the fluff pulp does not comprise a super-absorbent polymer (SAP).

24. The fluff pulp of claim 18, wherein the fluff pulp has a carboxyl content of more than about 3.5 meq/100 grams.

25. A process for preparing the fluff pulp of claim 18, comprising:

treating the bleached kraft fiber by adding copper or salts thereof to the bleached kraft fiber to produce the fluff pulp;

wherein the fluff pulp has at least 50% greater inhibiting effect on ammonia formation than a second bleached kraft fiber formed by the same process absent copper.

26. The process of claim 25, wherein the copper or salts thereof consist of one or more of elemental copper ($Cu^0$), a copper (I) salt, and a copper (II) salt.

27. The process of claim 25, wherein the copper or salts thereof consist of elemental copper, copper (I) chloride, copper (I) oxide, copper (I) sulfate, copper (II) carbonate, copper (II) chloride, copper (II) phosphate, copper(II) nitrate, copper (II) perchlorate, copper (II) phosphate, copper (II) sulfate, copper (II) tetrafluoroborate, copper (II) triflate, hydrates thereof, or combinations of any two or more thereof.

28. The process of claim 25, further comprising bleaching a kraft fiber with a multi-step bleaching process to produce a bleached kraft fiber, wherein the treating occurs after the bleaching.

29. The process of claim 25, further comprising bleaching a kraft fiber with a multi-step bleaching process to produce a bleached kraft fiber, wherein no further bleaching is performed after the treating.

30. The process of claim 25, wherein the fluff pulp does not comprise a super-absorbent polymer (SAP).

31. The process of claim 25, wherein the fluff pulp has a carboxyl content of more than about 3.5 meq/100 grams.

32. The process of claim 25, wherein the fluff pulp further comprises iron ions.

33. The process of claim 32, wherein the fluff pulp comprises an iron ion content from about 0.2 ppm to about 50 ppm by weight of the bleached kraft fiber.

34. The process of claim 25, comprising treating the bleached kraft fiber by adding from about 0.7 ppm to about 3.7 ppm by weight of the bleached kraft fiber of copper or salts thereof to produce the fluff pulp.

35. A process for preparing a fluff pulp, comprising:

treating bleached kraft fiber by adding from about 0.2 ppm to about 50 ppm by weight of the bleached kraft fiber of copper or salts thereof to produce the fluff pulp;

wherein the fluff pulp comprises a bleached kraft fiber comprising a length-weighted average fiber length of at least about 2 mm;

a copper number of less than about 7; and a ISO brightness of at least 80, and a copper ion content from about 0.2 ppm to about 50 ppm by weight of the bleached kraft fiber;

wherein the fluff pulp has at least 50% greater inhibiting effect on ammonia formation than a second bleached kraft fiber formed by the same process absent copper.

36. The process of claim 35, wherein the copper or salts thereof consist of one or more of elemental copper ($Cu^0$), a copper (I) salt, and a copper (II) salt.

37. The process of claim 35, wherein the copper or salts thereof consist of elemental copper, copper (I) chloride, copper (I) oxide, copper (I) sulfate, copper (II) carbonate, copper (II) chloride, copper (II) phosphate, copper(II) nitrate, copper (II) perchlorate, copper (II) phosphate, copper (II) sulfate, copper (II) tetrafluoroborate, copper (II) triflate, hydrates thereof, or combinations of any two or more thereof.

38. The process of claim 35, further comprising bleaching a kraft fiber with a multi-step bleaching process to produce a bleached kraft fiber, wherein the treating occurs after the bleaching.

39. The process of claim 35, further comprising bleaching a kraft fiber with a multi-step bleaching process to produce a bleached kraft fiber, wherein no further bleaching is performed after the treating.

40. The process of claim 35, wherein the fluff pulp does not comprise a super-absorbent polymer (SAP).

41. The process of claim 35, wherein the fluff pulp has a carboxyl content of more than about 3.5 meq/100 grams.

42. The process of claim 35, wherein the fluff pulp further comprises iron ions.

43. The process of claim 42, wherein the fluff pulp comprises an iron ion content from about 0.2 ppm to about 50 ppm by weight of the bleached kraft fiber.

44. The process of claim 35, comprising treating the bleached kraft fiber by adding from about 0.7 ppm to about 3.7 ppm by weight of the bleached kraft fiber of copper or salts thereof to produce the fluff pulp.

* * * * *